US008851855B2

(12) United States Patent
James et al.

(10) Patent No.: US 8,851,855 B2
(45) Date of Patent: Oct. 7, 2014

(54) COMPOSITE TURBOMACHINE BLADE

(75) Inventors: Darren I. James, Ashby-de-la-Zouch (GB); Nicholas M. Merriman, Derby (GB)

(73) Assignee: Rolls-Royce PLC, London (GB)

( * ) Notice: Subject to any disclaimer, the term of this patent is extended or adjusted under 35 U.S.C. 154(b) by 718 days.

(21) Appl. No.: 13/160,028

(22) Filed: Jun. 14, 2011

(65) Prior Publication Data

US 2012/0003100 A1 Jan. 5, 2012

(30) Foreign Application Priority Data

Jul. 5, 2010 (GB) ..... 1011228.2

(51) Int. Cl.
*F01D 5/28* (2006.01)

(52) U.S. Cl.
CPC ..... *F01D 5/282* (2013.01); *F05D 2260/941* (2013.01); *F05D 2240/303* (2013.01)
USPC ..... 416/224

(58) Field of Classification Search
CPC ..... F01D 5/14; F01D 5/26; F01D 5/28; F01D 5/282; F01D 5/286; F01D 5/288; F01D 25/04
USPC ..... 416/224, 223 R, 241 R
See application file for complete search history.

(56) References Cited

U.S. PATENT DOCUMENTS 1,793,775 A * 2/1931 Charavay ..... 416/224
2,389,760 A * 11/1945 Brierley ..... 416/224
3,200,477 A 8/1965 Shultz
3,892,612 A * 7/1975 Carlson et al. ..... 156/150
4,738,594 A * 4/1988 Sato et al. ..... 416/224
4,784,575 A * 11/1988 Nelson et al. ..... 416/226

(Continued)

FOREIGN PATENT DOCUMENTS

EP 1 302 562 A1 4/2003
EP 2 159 378 A2 3/2010

(Continued)

OTHER PUBLICATIONS

Search Report issued in British Application No. GB1011228.2 dated Oct. 13, 2010.

(Continued)

*Primary Examiner* — Edward Look
*Assistant Examiner* — Aaron R Eastman
(74) *Attorney, Agent, or Firm* — Oliff PLC

(57) ABSTRACT

A composite turbomachine blade (34) comprises a composite material including reinforcing fibers in a matrix material, the turbomachine blade (34) comprises an aerofoil portion (36), a shank portion (38) and a root portion (40). The aerofoil portion (36) has a leading edge (42), a trailing edge (44). The composite turbomachine blade (34) also has a metallic protective member (52) arranged in the region of the leading edge (42) of the aerofoil portion (36) of the turbomachine blade (34). The metallic protective member (52) is adhesively bonded to the composite material in the region of the leading edge (42) of the aerofoil portion (36) of the composite turbomachine blade (34). The metallic protective member (52) has at least one metallic projection (56, 58) extending from the metallic protective member (52) towards the root portion (40) of the composite turbomachine blade (34). The at least one metallic projection (56, 58) reduces local peak stress levels and increases high cycle fatigue strength in the composite material, the adhesive and the metallic protective member.

18 Claims, 4 Drawing Sheets

(56) References Cited

U.S. PATENT DOCUMENTS

| | | | | |
|---|---|---|---|---|
| 5,141,400 | A * | 8/1992 | Murphy et al. | 416/204 A |
| 5,449,273 | A * | 9/1995 | Hertel et al. | 416/224 |
| 5,800,129 | A * | 9/1998 | Lorin De La Grandmaison et al. | 416/224 |
| 6,250,880 | B1 * | 6/2001 | Woodard et al. | 415/182.1 |
| 6,413,051 | B1 | 7/2002 | Chou et al. | |
| 7,637,721 | B2 * | 12/2009 | Driver et al. | 416/224 |
| 2008/0038113 | A1 * | 2/2008 | Matsumoto et al. | 415/209.4 |
| 2008/0075601 | A1 * | 3/2008 | Giusti et al. | 416/229 A |
| 2009/0148302 | A1 * | 6/2009 | Leahy et al. | 416/224 |

FOREIGN PATENT DOCUMENTS

| | | |
|---|---|---|
| GB | 1 186 486 | 4/1970 |
| GB | 1 500 776 | 2/1978 |
| GB | 2 288 441 A | 10/1995 |

OTHER PUBLICATIONS

European Search Report dated May 15, 2014 from European Patent Application No. 11 16 9739.

* cited by examiner

COMPOSITE TURBOMACHINE BLADE

The present invention relates to a composite turbomachine blade and in particular to a composite gas turbine engine blade, e.g. a composite fan blade.

Composite turbomachine blades are provided with protective strips on the leading edges of the aerofoil portions of the turbomachine blades in order to protect the leading edges from erosion due to small foreign body, e.g. grit, and to protect the leading edges from large foreign body impacts, e.g. birds.

The protective strips are commonly metallic protective strips. The protective strips are generally adhesively bonded to the leading edges of the aerofoil portions of the composite turbomachine blades. However, the peel stresses at the radially inner ends of the protective strips have not been optimised, leading to premature fracture of the adhesive bonds between the protective strips and the leading edges of the aerofoil portions of the composite turbomachine blades during certain loading conditions, such as impacts from a bird, or birds. In addition the high cycle fatigue strength is reduced. Failure of the adhesive bonds between the protective strips and the leading edges of the aerofoil portions of the composite turbomachine blades may mean that composite turbomachine blades will fail to meet certification requirements when subjected to certain loads. Furthermore, end loads from the protective strips on the leading edges of the aerofoil portions of the turbomachine blades may cause stress concentrations within the composite turbomachine blades, which may lead to failure, or damage, to the composite turbomachine blade.

Accordingly the present invention seeks to provide a novel composite turbomachine blade which reduces, preferably overcomes, the above mentioned problems.

Accordingly the present invention provides a composite turbomachine blade comprising a composite material including reinforcing fibres in a matrix material, the turbomachine blade comprising an aerofoil portion, a shank portion and a root portion, the aerofoil portion having a tip remote from the shank portion, a leading edge, a trailing edge, a pressure surface extending from the leading edge to the trailing edge and a suction surface extending from the leading edge to the trailing edge, the composite turbomachine blade also having a protective member arranged in the region of the leading edge of the aerofoil portion of the turbomachine blade, the protective member being adhesively bonded to the composite material in the region of the leading edge of the aerofoil portion of the composite turbomachine blade, the protective member having at least one projection extending from the protective member towards the root portion of the composite turbomachine blade, the at least one projection extending from an end of the protective member nearest the root portion of the composite turbomachine blade towards the root portion of the composite turbomachine blade, whereby the at least one projection reduces local peak stress levels in the composite material, the adhesive and the protective member to increase high cycle fatigue strength of the composite material, the adhesive and the protective member.

The at least one projection may extend onto the shank portion of the composite turbomachine blade. The at least one projection may extend onto the root portion of the composite turbomachine blade.

The at least one projection may taper in thickness towards the root portion of the composite turbomachine blade. The at least one projection may reduce in thickness gradually or in a stepped manner towards the root portion of the composite turbomachine blade.

The protective member may have two projections, a first one of the projections being arranged on the pressure surface of the aerofoil portion of the composite turbomachine blade and a second one of the projections being arranged on the suction surface of the aerofoil portion of the composite turbomachine blade.

The reinforcing fibres may comprise carbon fibre and/or glass fibres. The matrix material may comprise a thermosetting resin.

The protective member may be a metallic protective member and the at least one projection is a metallic projection.

The protective member may extend the full length of the aerofoil portion from the tip to the shank portion.

The protective member may not extend over a leading edge of the majority of the shank portion.

The at least one projection may be flexible.

The at least one projection may be arranged on the pressure surface of the aerofoil portion of the composite turbomachine blade or the at least one projection may be arranged on the suction surface of the aerofoil portion of the composite turbomachine blade.

The composite turbomachine blade may be a composite gas turbine engine blade. The composite turbomachine blade may be a fan blade.

A turbomachine rotor assembly comprising a turbomachine rotor and a plurality of circumferentially spaced radially extending composite turbomachine blades.

The present invention will be more fully described by way of example with reference to the accompanying drawings, in which.

Figure 1:
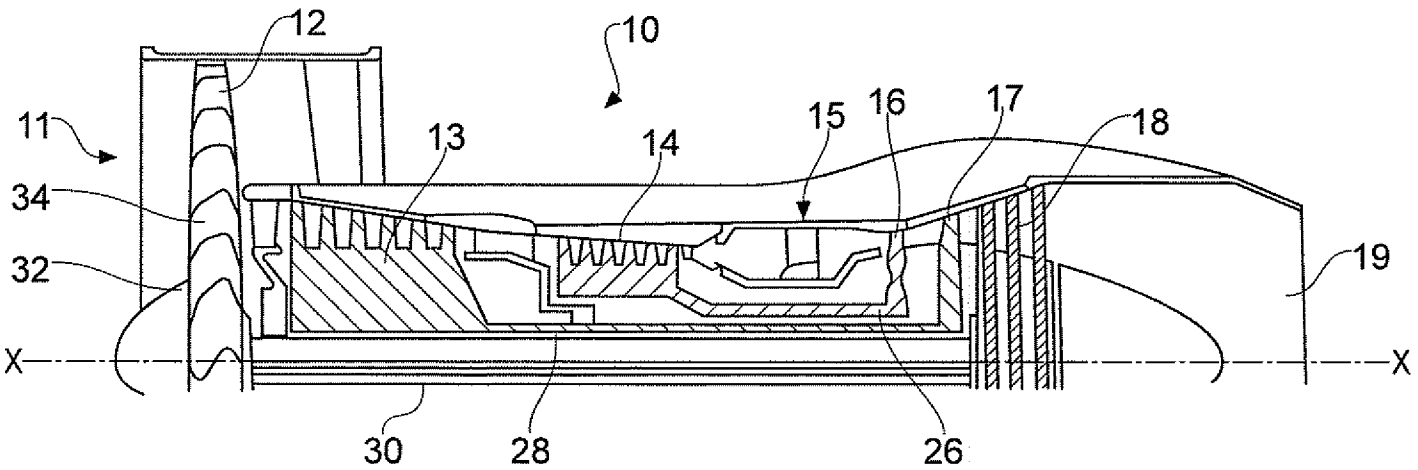
FIG. 1 is a cross-sectional view of an upper half of turbomachine, a turbofan gas turbine engine having a composite turbomachine blade according to the present invention.

A turbofan gas turbine engine 10, as shown in FIG. 1, comprises in flow series an intake 11, a fan 12, an intermediate pressure compressor 13, a high pressure compressor 14, a combustor 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 19 is arranged to drive the fan 12 via a third shaft 30. In operation air flows into the intake 11 and is compressed by the fan 12. A first portion of the air flows through, and is compressed by, the intermediate pressure compressor 13 and the high pressure compressor 14 and is supplied to the combustor 15. Fuel is injected into the combustor 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine to provide propulsive thrust.

The fan 12 comprises a fan rotor 32 carrying a plurality of circumferentially spaced radially outwardly extending fan blades 34. The fan blades 34 are composite fan blades and each fan blade 34 comprises a composite material including reinforcing fibres in a matrix material.

Figure 2:
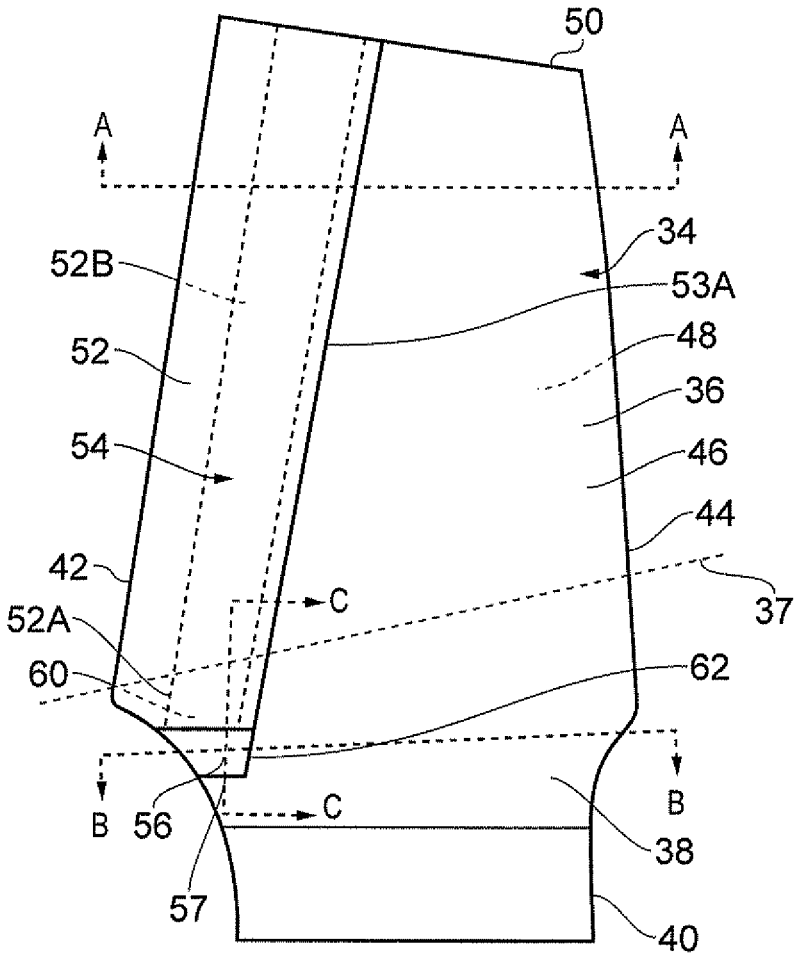
FIG. 2 is an enlarged view of a composite turbomachine blade according to the present invention.
Figure 3:
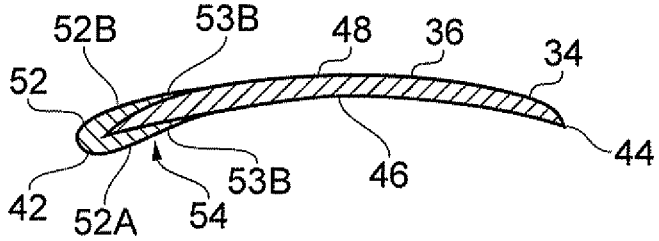
FIG. 3 is a cross-sectional view in the direction of arrows A-A in FIG. 2.
Figure 4:
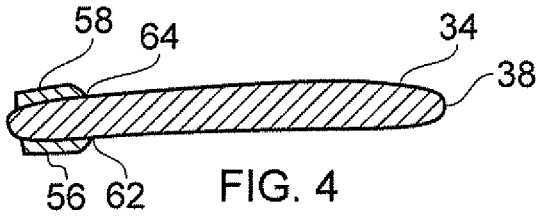
FIG. 4 is a cross-sectional view in the direction of arrows B-B in FIG. 2.
Figure 5:
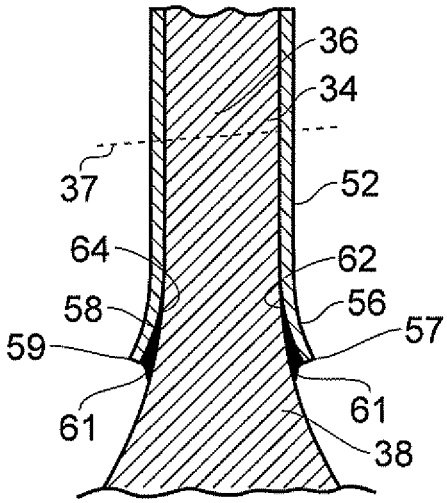
FIG. 5 is an enlarged cross-sectional view in the direction of arrows C-C in FIG. 2.
Figure 6:
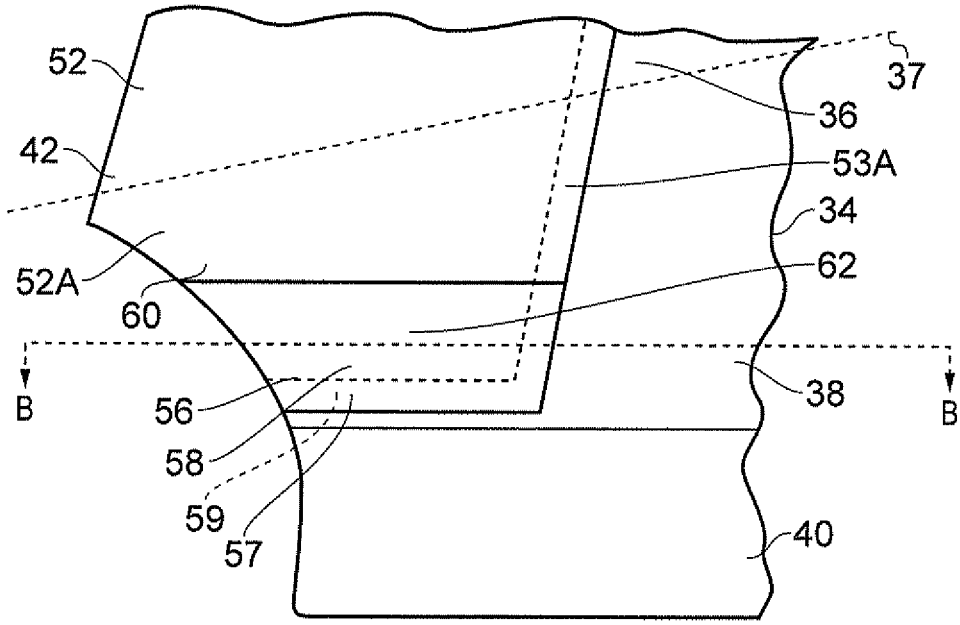
FIG. 6 is a further enlarged view of a portion of the composite turbomachine blade shown in FIG. 2.

Each fan blade 34, as shown in FIGS. 2, 3, 4, 5 and 6, comprises an aerofoil portion 36, a shank portion 38 and a root portion 40. The aerofoil portion 36 has a leading edge 42, a trailing edge 44, a pressure surface 46 extending from the leading edge 42 to the trailing edge 44, a suction surface 48 extending from the leading edge 42 to the trailing edge 44 and a tip 50 remote from the root portion 40. The composite fan blade 34 also has a metallic protective member 52 arranged in the region 54 of the leading edge 42 of the aerofoil portion 36 of the fan blade 34. The metallic protective member 52 is adhesively bonded to the composite material in the region 54 of the leading edge 42 of the aerofoil portion 36 of the composite fan blade 34. The metallic protective member 52 thus has portions 52A and 52B adhesively bonded to the pressure surface 46 and the suction surface 48 respectively of the aerofoil portion 36 of the composite fan blade 34. The metallic protective member 52 extends the full length of the aerofoil portion 36 from the tip 50 to the shank portion 38. The metallic protective member 52 also has two metallic projections 56 and 58 which extend from an end, a radially inner end, 60 of the metallic protective member 52 nearest the root portion 40 towards the root portion 40 of the composite fan blade 34. The metallic projections 56 and 58 reduce the local peak stress levels in the composite material, the adhesive and the metallic protective member and increase high cycle fatigue strength of the composite material, the adhesive and the metallic protective member. The metallic projections 56 and 58 are adhesively bonded, as shown at 61, to the pressure surface 46 and the suction surface 48 respectively of the aerofoil portion 36 of the composite fan blade 34. The metallic protective member 52 only extends a relatively small distance onto the shank portion 38 of the fan blade 34 and does not extend onto the root portion 40 of the fan blade 34, the metallic projections 56 and 58 extend onto the shank portion 38 and thus there is only a relatively small amount of metallic protective member 52 at the leading edge of the shank portion 38. There is no metallic protective member 52 at the leading edge of the majority of the shank portion 38 as seen in FIGS. 4 and 6. The metallic protective member 52 extends to a position radially below an annulus line 37, the annulus line 37 defines a position radially outwardly of which a working fluid is arranged to flow over the aerofoil portion 36 of the fan blade 34 in operation and radially inwardly of which working fluid is not arranged to flow over the shank portion 38 and the root portion 40 in operation. Thus, the shank portion 38 and the root portion 40 do not have aerodynamic surfaces.

A first one of the metallic projections 56 is arranged on the first surface 62 of the shank portion 38 of the composite fan blade 34 and a second one of the metallic projections 58 is arranged on a second surface 64 of the shank portion 38 of the composite fan blade 34. The metallic projections 56 and 58 extend from the metallic protective member 52 onto the first surface 62 and second surface 64 of the shank portion 38 from the pressure surface 46 and suction surface 48 respectively of the aerofoil portion 36 of the composite fan blade 34. The metallic projections 56 and 58 are flexible, resilient, because there is no interconnecting portion of metal extending around the leading edge of the shank portion 38. The metallic projections 56 and 58 effectively extend the end 60 of the metallic protective member 52 and the change in stiffness between the root portion 40 of the composite fan blade 34 and the metallic protective member 52 is made much less severe. This has the effect of reducing local peak stresses during an impact by a bird and increasing the high cycle fatigue strength during steady operating conditions of the turbofan gas turbine engine 10. The metallic projections 56 and 58 increase the area for adhesive bonding between the metallic protective member 52 and the composite fan blade 34. The metallic projections 56 and 58 minimise stresses in the bond regions between the metallic protective member 52 and the composite fan blade 34 and spreads the stresses radially inwardly of the annulus line 37.

The metallic projections 56 and 58 taper in thickness, have chamfers, 57 and 59 towards the root portion 40 of the composite fan blade 34. The metallic projections 56 and 58 may reduce in thickness towards the root portion 40 of the composite fan blade 34, the metallic projections 56 and may reduce in thickness gradually or in a stepped manner. In addition the portions 52A and 52B of the metallic protective member 52 taper in thickness, have chamfers, 53A and 53B in a direction towards the trailing edge 44 of the composite fan blade 34. The chamfers 57 and 59 on the metallic projections 56 and 58 and the chamfers 53A and 53B on the portions 52A and 52B of the metallic protective member 52 also contribute to the effect of reducing local peak stresses during an impact by a bird and increasing the high cycle fatigue strength during steady operating conditions of the turbofan gas turbine engine 10.

Figure 7:
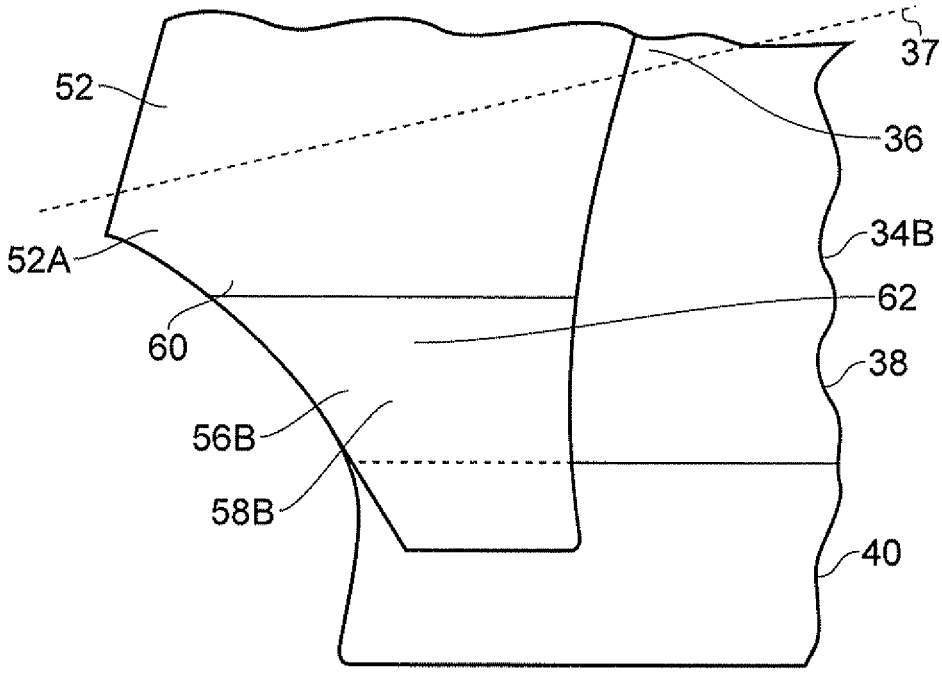
FIG. 7 is a further enlarged view of an alternative embodiment of a portion of the composite turbomachine blade shown in FIG. 2.

An alternative arrangement of fan blade 34B is shown in FIGS. 2, 3 and 7, and this is similar to that shown in FIGS. 2, 3 and 6 and like parts are denoted by like numerals. The fan blade 34B differs in that the metallic projections 56B and 58B extend onto, and are adhesively bonded to the root portion 40 of the composite fan blade 34B. This arrangement provides an electrically conductive path for lightning from the metallic protective member 52 of the aerofoil portion 36 of the composite fan blade 34B radially inwardly to the fan rotor 32, the fan rotor 32 is metallic and thus conducts the lightning away from the composite fan blades 34B in use. The electrically conductive path is provided by contact between the metallic projections 56B and/or 58B and the fan rotor 32 or by close proximity, a small gap, between the metallic projections 56B and/or 58B and the fan rotor 32 such that the lightning may cross the small gap during a lightning strike.

Figure 8:
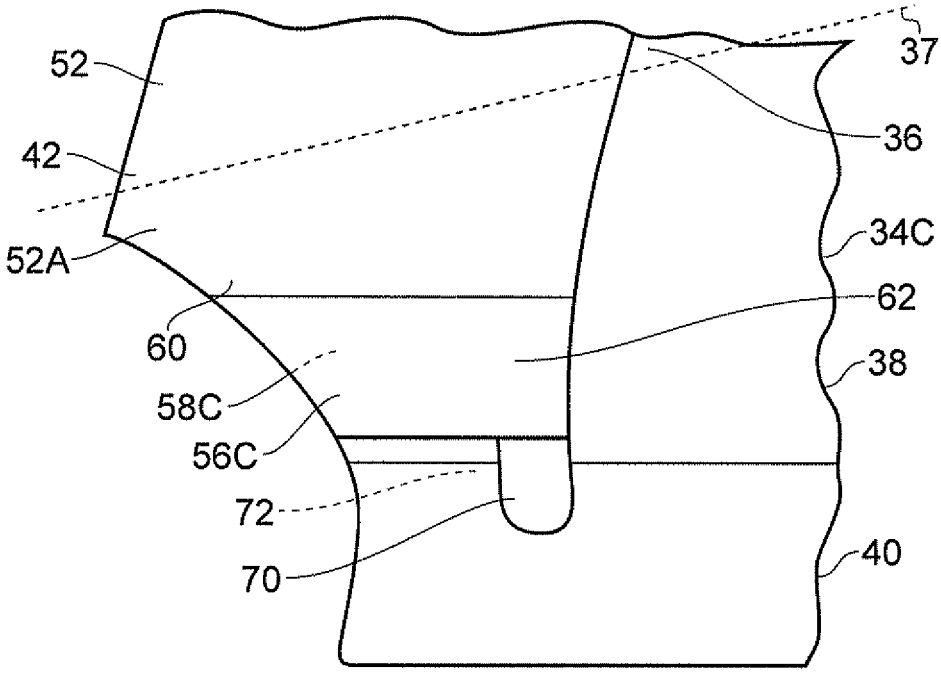
FIG. 8 is a further enlarged view of another embodiment of a portion of the composite turbomachine blade shown in FIG. 2.

A further arrangement of fan blade 34C is shown in FIGS. 2, 3 and 8, and this is similar to that shown in FIGS. 2, 3 and 6 and like parts are denoted by like numerals. The fan blade 34C differs in that the metallic projections 56C and 58C have localised electrically conducting leads 70 and 72 which extend onto, and are adhesively bonded to the root portion 40 of the composite fan blade 34C. This arrangement also provides an electrically conductive path for lightning from the metallic protective member 52 of the aerofoil portion 36 of the composite fan blade 34C radially inwardly to the fan rotor 32, the fan rotor 32 is metallic and thus conducts the lightning away from the composite fan blades 34C. The electrically conducting leads 70 and 72 are electrically connected to the fan rotor 32 in use.

The root portion 40 of the fan blade 34 may be a dovetail root, or a fir tree root, for location in a correspondingly shaped slot in the fan rotor 32.

The reinforcing fibres of the composite material may comprise carbon fibres and/or glass fibres and the matrix material of the composite material may comprise a thermosetting resin, e.g. an epoxy resin. The reinforcing fibres may comprise boron fibres, aramid fibres or polyaramid fibres, e.g. Kevler®, or any other suitable fibres. The matrix material may comprise thermoplastic materials, e.g. PEEK polyetheretherketone. The fan rotor may comprise a titanium alloy or any other suitable metal or alloy. The metallic protective member may comprise a titanium alloy, e.g. Ti-6-4 which consists of 6 wt % aluminium, 4 wt % vanadium and the remainder titanium plus minor additions and incidental impurities. The metallic protective member may comprise a nickel alloy, e.g. IN318, or steel or any other suitable metal or alloy. A protective member and associated projections comprising other materials may be used.

Although the present invention has been described with reference to a composite turbofan gas turbine engine fan blade the present invention is equally applicable to other composite gas turbine engine rotor blades, e.g. composite compressor blades. The present invention is equally applicable to other composite turbomachine rotor blades and composite turbomachine stator vanes.

Although the present invention has been described with reference to a metallic projection extending from the metallic leading edge on each surface of the composite turbomachine blade it may be possible to provide a metallic projection on one surface only of the composite turbomachine blade or to provide more than two metallic projections on each surface of the composite turbomachine blade.

The invention claimed is:

1. A composite turbomachine blade comprising:

a composite material including reinforcing fibres in a matrix material, the turbomachine blade comprising:

an aerofoil portion, a shank portion and a root portion, the aerofoil portion having a tip remote from the shank portion, a leading edge, a trailing edge, a pressure surface extending from the leading edge to the trailing edge and a suction surface extending from the leading edge to the trailing edge, the composite turbomachine blade also having a protective member arranged in the region of the leading edge of the aerofoil portion of the turbomachine blade, the protective member being adhesively bonded to the composite material in the region of the leading edge of the aerofoil portion of the composite turbomachine blade, the protective member extending around the leading edge of the aerofoil portion, the protective member having portions adhesively bonded to the pressure surface and suction surface of the aerofoil portion, the protective member having an end nearest to and spaced apart from the root portion of the composite turbomachine blade, the protective member having at least one projection extending from the protective member towards the root portion of the composite turbomachine blade, the at least one projection extending from an end of the protective member nearest the root portion of the composite turbomachine blade towards the root portion of the composite turbomachine blade, the at least one projection not extending around the leading edge of the composite turbomachine blade and not extending around the trailing edge of the composite turbomachine blade, wherein the at least one projection extends onto the shank portion of the composite turbomachine blade, whereby the at least one projection reduces local peak stress levels in the composite material, the adhesive and the protective member and increases high cycle fatigue strength of the composite material, the adhesive and the protective member.

2. A composite turbomachine blade as claimed in claim 1 wherein the at least one projection extends onto the root portion of the composite turbomachine blade.

3. A composite turbomachine blade as claimed in claim 1 wherein the at least one projection tapers in thickness towards the root portion of the composite turbomachine blade.

4. A composite turbomachine blade as claimed in claim 3 wherein the at least one projection reduces in thickness gradually towards the root portion of the composite turbomachine blade.

5. A composite turbomachine blade as claimed in claim 1 wherein the protective member having two projections, a first one of the projections being arranged on the pressure surface of the aerofoil portion of the composite turbomachine blade and a second one of the projections being arranged on the suction surface of the aerofoil portion of the composite turbomachine blade.

6. A composite turbomachine blade as claimed in claim 1 wherein the reinforcing fibres comprise carbon fibres and/or glass fibres.

7. A composite turbomachine blade as claimed in claim 1 wherein the matrix material comprises a thermosetting resin.

8. A composite turbomachine blade as claimed in claim 1 wherein the composite turbomachine blade is composite gas turbine engine blade.

9. A composite turbomachine blade as claimed in claim 1 wherein the composite turbomachine blade is a fan blade.

10. A composite turbomachine blade as claimed in claim 1 wherein the protective member is a metallic protective member and the at least one projection is a metallic projection.

11. A composite turbomachine blade as claimed in claim 1 wherein the protective member extends the full length of the aerofoil portion from the tip to the shank portion.

12. A composite turbomachine blade as claimed in claim 1 wherein the protective member does not extend over a leading edge of the majority of the shank portion.

13. A composite turbomachine blade as claimed in claim 1 wherein the at least one projection is flexible.

14. A composite turbomachine blade as claimed in claim 1 wherein the at least one projection is arranged on the pressure surface of the aerofoil portion of the composite turbomachine blade.

15. A composite turbomachine blade as claimed in claim 1 wherein the at least one projection is arranged on the suction surface of the aerofoil portion of the composite turbomachine blade.

16. A composite turbomachine blade comprising:

a composite material including reinforcing fibres in a matrix material, the turbomachine blade comprising:

an aerofoil portion, a shank portion and a root portion, the aerofoil portion having a tip remote from the shank portion, a leading edge, a trailing edge, a pressure surface extending from the leading edge to the trailing edge and a suction surface extending from the leading edge to the trailing edge, the composite turbomachine blade also having a protective member arranged in the region of the leading edge of the aerofoil portion of the turbomachine blade, the protective member extends the full length of the aerofoil portion from the tip to the shank portion, the protective member being adhesively bonded to the composite material in the region of the leading edge of the aerofoil portion of the composite turbomachine blade, the protective member extending around the leading edge of the aerofoil portion, the protective member having portions adhesively bonded to the pressure surface and suction surface of the aerofoil portion, the protective member having an end nearest to and spaced apart from the root portion of the composite turbomachine blade, the protective member having at least one projection extending from the protective member towards the root portion of the composite turbomachine blade, the at least one projection extending from an end of the protective member nearest the root portion of the composite turbomachine blade towards the root portion of the composite turbomachine blade, the at least one projection extending onto the shank portion of the composite turbomachine blade, the at least one projection not extending around the leading edge of the composite turbomachine blade, the at least one projection being arranged to reduce local peak stress levels in the composite material, the adhesive and the protective member and to increase high cycle fatigue strength of the composite material, the adhesive and the protective member.

17. A turbomachine rotor assembly comprising a turbomachine rotor and a plurality of circumferentially spaced radially extending composite turbomachine blades as claimed in claim 1.

18. A composite turbomachine blade comprising:

a composite material including reinforcing fibres in a matrix material, the turbomachine blade comprising:

an aerofoil portion, a shank portion and a root portion, the aerofoil portion having a tip remote from the shank portion, a leading edge, a trailing edge, a pressure surface extending from the leading edge to the trailing edge and a suction surface extending from the leading edge to the trailing edge, the composite turbomachine blade also having a protective member arranged in the region of the leading edge of the aerofoil portion of the turbomachine blade, the protective member being adhesively bonded to the composite material in the region of the leading edge of the aerofoil portion of the composite turbomachine blade, the protective member extending around the leading edge of the aerofoil portion, the protective member having portions adhesively bonded to the pressure surface and suction surface of the aerofoil portion, the protective member having an end nearest to and spaced apart from the root portion of the composite turbomachine blade, the protective member having at least one projection extending from the protective member towards the root portion of the composite turbomachine blade, the at least one projection extending from an end of the protective member nearest the root portion of the composite turbomachine blade towards the root portion of the composite turbomachine blade, the at least one projection being spaced from the leading edge, wherein the at least one projection extends onto the shank portion of the composite turbomachine blade, whereby the at least one projection reduces local peak stress levels in the composite material, the adhesive and the protective member and increases high cycle fatigue strength of the composite material, the adhesive and the protective member.

* * * * *